US009540206B2

(12) United States Patent
Masuda et al.

(10) Patent No.: US 9,540,206 B2
(45) Date of Patent: Jan. 10, 2017

(54) IMAGE FORMING APPARATUS

(71) Applicant: Brother Kogyo Kabushiki Kaisha, Nagoya (JP)

(72) Inventors: Takehiro Masuda, Nagoya (JP); Masafumi Inoue, Tajimi (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/068,765

(22) Filed: Mar. 14, 2016

(65) Prior Publication Data

US 2016/0280496 A1 Sep. 29, 2016

(30) Foreign Application Priority Data

Mar. 25, 2015 (JP) ..... 2015-062993

(51) Int. Cl.
*B65H 29/60* (2006.01)
*B65H 29/14* (2006.01)
*B65H 31/24* (2006.01)

(52) U.S. Cl.
CPC ..... *B65H 29/60* (2013.01); *B65H 29/14* (2013.01); *B65H 31/24* (2013.01); *B65H 2404/632* (2013.01); *B65H 2404/7414* (2013.01)

(58) Field of Classification Search
CPC ..... B65H 29/58; B65H 29/60; B65H 29/64; B65H 31/24; B65H 2404/63; B65H 2404/632; B65H 2404/7414
See application file for complete search history.

(56) References Cited

U.S. PATENT DOCUMENTS 5,234,213 A * 8/1993 Chen ..... B65H 29/58 271/186
5,810,353 A * 9/1998 Baskette ..... B65H 29/60 271/279
6,547,241 B2 * 4/2003 Yoshida ..... B65H 29/60 271/303
6,776,408 B2 * 8/2004 Suzuki ..... B65H 29/60 271/188

(Continued)

FOREIGN PATENT DOCUMENTS

JP 2000-233872 A 8/2000
JP 2002-268410 A 9/2002

(Continued)

*Primary Examiner* — Ernesto Suarez
(74) *Attorney, Agent, or Firm* — Burr & Brown, PLLC

(57) ABSTRACT

An image forming apparatus, having a housing, a flapper swingable relatively to the housing between a first position and a second position; a pressure link swingable relatively to the housing and the flapper, a first contact surface arranged on the housing, a first urging member to urge the flapper to swing relatively to the pressure link toward the first contact surface, a second urging member to urge the pressure link to act on the flapper to tend toward staying in the first position, and a flapper switcher having a pressure applier movable between a pressing position and a separated position, is provided. The flapper is swingable relatively to the pressure link against an urging force from the first urging member, after the pressure applier presses the pressure link to move the flapper from the first position to the second position and when the flapper contacts the first contact surface.

10 Claims, 6 Drawing Sheets

(56) References Cited

U.S. PATENT DOCUMENTS

| | | | | |
|---|---|---|---|---|
| 7,845,639 | B2 * | 12/2010 | Lyga | B65H 29/58 271/176 |
| 8,387,980 | B2 * | 3/2013 | Kang | B41J 13/009 271/225 |
| 8,838,008 | B2 * | 9/2014 | Nara | B65H 29/58 271/184 |
| 9,221,644 | B2 * | 12/2015 | Kobayashi | B65H 1/04 |
| 2002/0158405 | A1 | 10/2002 | Nagasako et al. | |

FOREIGN PATENT DOCUMENTS

| | | | |
|---|---|---|---|
| JP | 2002-356270 | A | 12/2002 |
| JP | 2006-062862 | A | 3/2006 |
| JP | 2007-091359 | A | 4/2007 |
| JP | 2007-106544 | A | 4/2007 |
| JP | 2008-162714 | A | 7/2008 |
| JP | 2008-230748 | A | 10/2008 |

* cited by examiner 9
94
97
96
91
97B
95A(95)

9
93
96
96A
91
92
91
LEFT
RIGHT
94
95A
95
97A
97
96
96A
91

IMAGE FORMING APPARATUS

CROSS REFERENCE TO RELATED APPLICATION

This application claims priority from Japanese Patent Application No. 2015-062993 filed on Mar. 25, 2015, the entire subject matter of which is incorporated herein by reference.

BACKGROUND

Technical Field

An aspect of the present invention relates to an image forming apparatus including a swingable flapper.

Related Art

An image forming apparatus having conveyer pathways, which are branched at a branch point, to convey sheets in different directions is known. The image forming apparatus may have a flapper disposed at the branch point to selectively open or close the conveyer pathways and a switcher device to operate the flapper to change positions thereof. Further, for example, the image forming apparatus may have a switcher arm, which may be coupled to the flapper. When the switcher device applies pressure to the switcher arm, the switcher arm may move the flapper to swing.

SUMMARY

The swing movement of the flapper may be restricted, when the flapper is subject to a predetermined amount of pressure, by a contacting part formed in a housing of the image forming apparatus. Meanwhile, due to mechanical tolerances allowed to the flapper, the switcher arm, and/or the switcher device, burden of a greater amount of pressure than the predetermined amount may be placed on the flapper. The flapper being subject to the greater amount of pressure may be urged against the contacting part forcibly and may be damaged.

The present disclosure is advantageous in that an image forming apparatus, which may restrain the flapper from being damaged, is provided.

According to an aspect of the present disclosure, an image forming apparatus, having a housing; a flapper configured to be swingable with respect to the housing on a swing track and movable between a first position and a second position on the swing track; a pressure link configured to be swingable with respect to the housing and the flapper, the pressure link being coupled to the flapper; a first contact surface arranged on the housing, the first contact surface being configured to contact the flapper and restrict the flapper from moving beyond the second position; a first urging member arranged between the pressure link and the flapper, the first urging member being configured to urge the flapper to swing with respect to the pressure link toward the first contact surface; a second urging member arranged between the housing and the pressure link, the second urging member being configured to urge the pressure link to act on the flapper to tend toward staying in the first position; and a flapper switcher having a pressure applier configured to move between a pressing position, in which the pressure applier presses the pressure link, and a separated position, in which the pressure applier is separated from the pressure link, is provided. The flapper is swingable with respect to the pressure link against an urging force from the first urging member, after the pressure applier presses the pressure link to move the flapper from the first position to the second position against an urging force from the second urging member and when the flapper being moved contacts the first contact surface.

BRIEF DESCRIPTION OF THE ACCOMPANYING DRAWINGS

DETAILED DESCRIPTION

Figure 1:
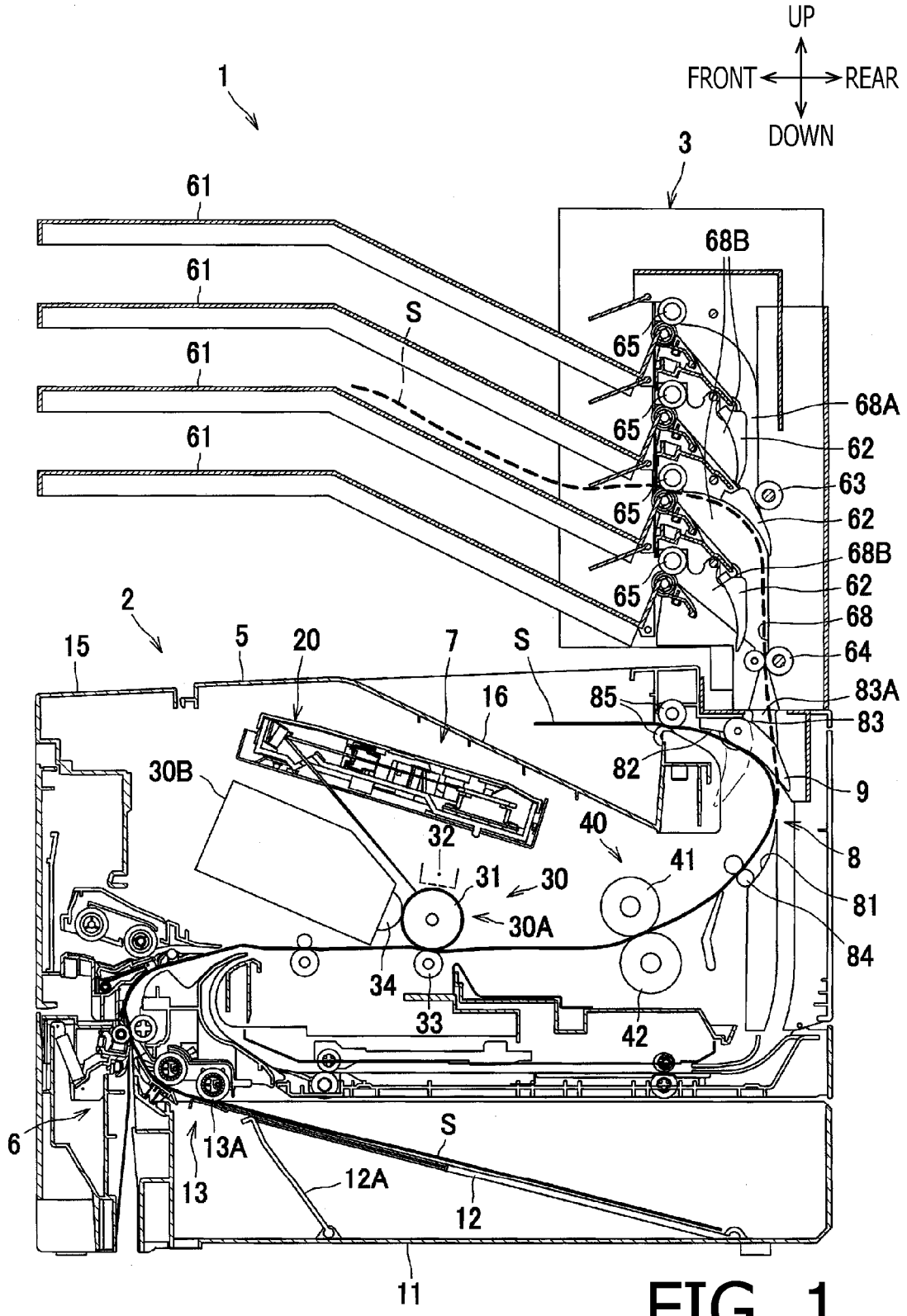
FIG. 1 is an illustrative cross-sectional side view of a laser printer according to an exemplary embodiment of the present disclosure.

Hereinafter, an exemplary configuration of a laser printer 1 according to an embodiment of the present disclosure will be described with reference to the accompanying drawings. In the following description, directions concerning the laser printer 1 will be referred to in accordance with a user's ordinary position to use the laser printer 1, as indicated by arrows in each drawing. For example, a viewer's right-hand side appearing in FIG. 1 is referred to as a rear side of the laser printer 1, and a right-hand side in FIG. 1 opposite from the rear side is referred to as a front side. A side which corresponds to the viewer's nearer side is referred to as a right-hand side for the user, and an opposite side from the left, which corresponds to the viewer's farther side is referred to as a left-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-6B are similarly based on the orientation of the laser printer 1 as defined above and correspond to those with respect to the laser printer 1 shown in FIG. 1 even when the drawings are viewed from different angles.

The laser printer 1 is capable of forming images on sheets S. The laser printer 1 includes, as shown in FIG. 1, a main body 2 and is attachable with a sheet-exit unit 3, which is capable of sorting the sheets S ejected out of the main body 2.

The main body 2 includes an image forming unit 7 to form images on the sheets S, a feeder unit 6 to feed the sheets S to the image forming unit 7, and a conveyer unit 8 to convey the sheets S, which are accommodated in a housing 5. The image forming unit 7 includes an exposure device 20, a processing unit 30 to form toner images on the sheets S, and a fixing device 40 to thermally fix the toner images on the sheets S.

The feeder unit 6 is disposed in a lower position in the housing 5 and includes a feeder tray 11, a sheet-pressing plate 12, and a feeder device 13. The sheet-pressing plate 12 is disposed at a bottom of the feeder tray 11, and a lifting member 12A is disposed underneath the sheet-pressing plate 12. The sheet-pressing plate 12 is rotatable about a rear end thereof to uplift a front end thereof by being uplifted by the lifting member 12A.

The feeder device 13 includes a pickup roller 13A and is configured to feed the sheets S placed on the feeder tray 11 one-by-one to the processing unit 30.

The exposure device 20 is disposed in an upper position in the housing 5 and includes a laser emitter (not shown), polygon mirrors, lenses, and reflection mirrors, which may be shown but unsigned. In the exposure device 20, a laser beam is emitted and transmitted to a surface of a photosensitive drum 31 in the processing unit 30 via the polygon mirrors, the lenses, and the reflection mirrors, which are unsigned, to scan the surface of the photosensitive drum 31.

The processing unit 30 is disposed in a lower position with respect to the exposure device 20 and includes a drum unit 30A and a developer cartridge 30B. The drum unit 30A includes the photosensitive drum 31, a charger 32, and a transfer roller 33. The developer cartridge 30B is attachable to the housing 5 through an opening (unsigned), which may be exposed when a front cover 15 is open. The developer cartridge 30B includes a developer roller 34, a supplier roller (not shown), a toner-spreader blade (not shown), a toner container (not shown), and an agitator to stir the toner in the toner container (not shown).

In the processing unit 30, as the photosensitive drum 31 rotates, a surface of the photosensitive drum 31 is electrically evenly charged by the charger 32 and partly exposed to the laser beam emitted from the exposure device 20 so that electrical charges of the exposed areas are lowered and an electrostatic latent image according to image data is formed to be carried on the surface of the photosensitive drum 31. Meanwhile, the toner in the developer cartridge 30B is supplied to the electrostatic latent image on the photosensitive drum 31 by the developer roller 34 being rotated. Thereby, the latent image is visualized and developed to be a toner image. In the meantime, as the sheet S is conveyed through a gap between the photosensitive drum 31 and the transfer roller 33, the toner image carried on the surface of the photosensitive drum 31 is transferred onto the sheet S.

The fixing device 40 is disposed in a rearward position with respect to the processing unit 30 and includes a heat roller 41 and a pressure roller 42, which nip the sheet S in a gap there-between. In the fixing device 40, the toner image transferred to the sheet S is thermally fixed thereon as the sheet S passes through the gap between the heat roller 41 and the pressure roller 42.

The conveyer unit 8 conveys the sheet S with the image formed thereon and passing through the image forming unit 7 to either a first outlet tray 16 or the sheet-exit unit 3.

The conveyer unit 8 includes a main conveyer path 81, a first outlet path 82, a second outlet path 83, and a flapper 9. The main conveyer path 81 is a pathway to guide the sheet S having been conveyed through the fixing device 6 upward. The first outlet path 82 diverges frontward from the main conveyer path 81 and guides the sheet S with the image formed thereon in the image forming unit 7 to the first outlet tray 16. The second outlet path 83 diverges upward from the main conveyer path 81 and guides the sheet S with the image formed thereon in the image forming unit 7 to the sheet-exit unit 3. The flapper 9 switches the pathways to convey the sheet S. The conveyer unit 8 further includes a conveyer roller 84, which is disposed in the main conveyer path 81, and an in-main body exit roller 85, which is disposed at an exit of the first outlet path 82. The housing 5 includes an opening 83A, through which the sheet S is ejected out of the main body 2 and conveyed to the sheet-exit unit 3, on an upper surface at a position corresponding to the second outlet path 83.

The flapper 9 is swingably attached to the main body 2 to swing frontward or rearward. The flapper 9 is movable to swing between a first position, as indicated by solid lines in FIG. 1, in which the sheet S is guided to the first outlet path 82, and a second position, as indicated by double-dotted lines in FIG. 1, which is a frontward position apart from the first position on a swing track of the flapper 9 and in which the sheet S is guided to the second outlet path 83. A configuration to move the flapper 9 will be described later in detail.

The sheet-exit unit 3 includes a plurality of second outlet trays 61, which are arranged to align vertically, a plurality of outlet rollers 65, each of which is arranged to correspond to one of the second outlet trays 61, an outlet path 68, through which the sheets S conveyed out of the main body 2 are further guided to the second outlet trays 61, and a first conveyer roller 63 and second conveyer roller 64 arranged in the outlet path 68.

The outlet path 68 is a pathway to guide, in connection with the second outlet path 83 in the main body 2, the sheets S with the images formed thereon to the second outlet trays 61. The outlet path 68 includes a first path 68A and a second path 68B. The first path 68 extends continuously from the second outlet path 83 through the opening 83A of the main body 2 to an uppermost one of the outlet trays 61. The second path 68B may include a plurality of second paths 68B, which diverge from the first path 68A and extend to each of the outlet trays 61 other than the uppermost outlet tray 61. In each position where the second outlet path 68B diverges from the first path 98A, disposed is a swingable member 62, which is swingable to switch directions to convey the sheets.

The first conveyer roller 63 is disposed in an intermediate position in the first path 68A. The second conveyer roller 64 is disposed in the first path 68A in a position upstream from the first conveyer roller 63 with regard to a conveying direction to convey the sheets S.

Figures 2A, 2B:
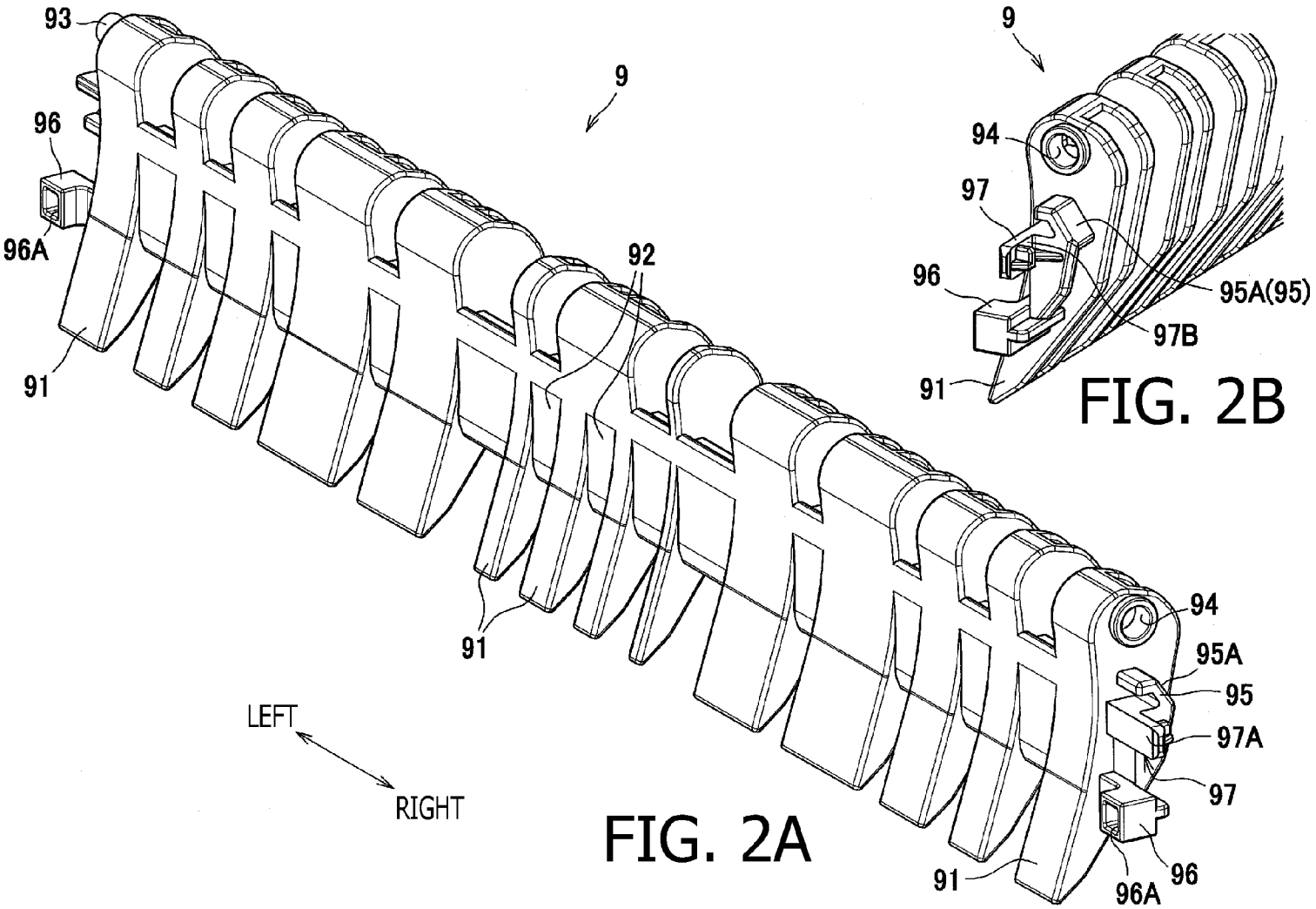
FIG. 2A is a perspective view of a flapper in the laser printer according to the exemplary embodiment of the present disclosure.
FIG. 2B is a perspective partial view of a widthwise end of the flapper in the laser printer according to the exemplary embodiment of the present disclosure.

Next, a configuration of the flapper 9 and a structure to move the flapper 9 will be described in detail. As shown in FIGS. 2A-2B, the flapper 9 includes a plurality of guiding parts 91, connecting parts 92, a shaft 93, a bearing 94, a spring presser 97, a first contacting part 95, and a second contacting part 96. The plurality of guiding parts 91 are arranged to align along the widthwise direction, and the connecting parts connect the plurality of guiding parts 91 together along the widthwise direction. The shaft 93 protrudes leftward from a leftmost one of the guiding parts 91. The bearing 94 is formed in a rightmost one of the guiding parts 91. The spring presser 97 is formed to protrude outward or rightward from the rightmost one of the guiding parts 91 in a direction of a swing axis A1 of the flapper 9. The first contacting part 95 and the second contacting part 96 are arranged on the leftmost one of the guiding parts 91 and the rightmost one of the guiding parts 91 respectively.

The shaft 93 is formed in an upper end position of the guide part 91 which is on the leftmost position. The bearing 94 is a circular dent, which is formed to recess inward or leftward from a rightward surface of the guide part 91 which is in the rightmost position. The bearing 94 is formed in an upper end position in the guiding part 91, in particular, in an arrangement such that a center of the circle coincides with a straight line extending through an axis of the shaft 93.

Figure 3:
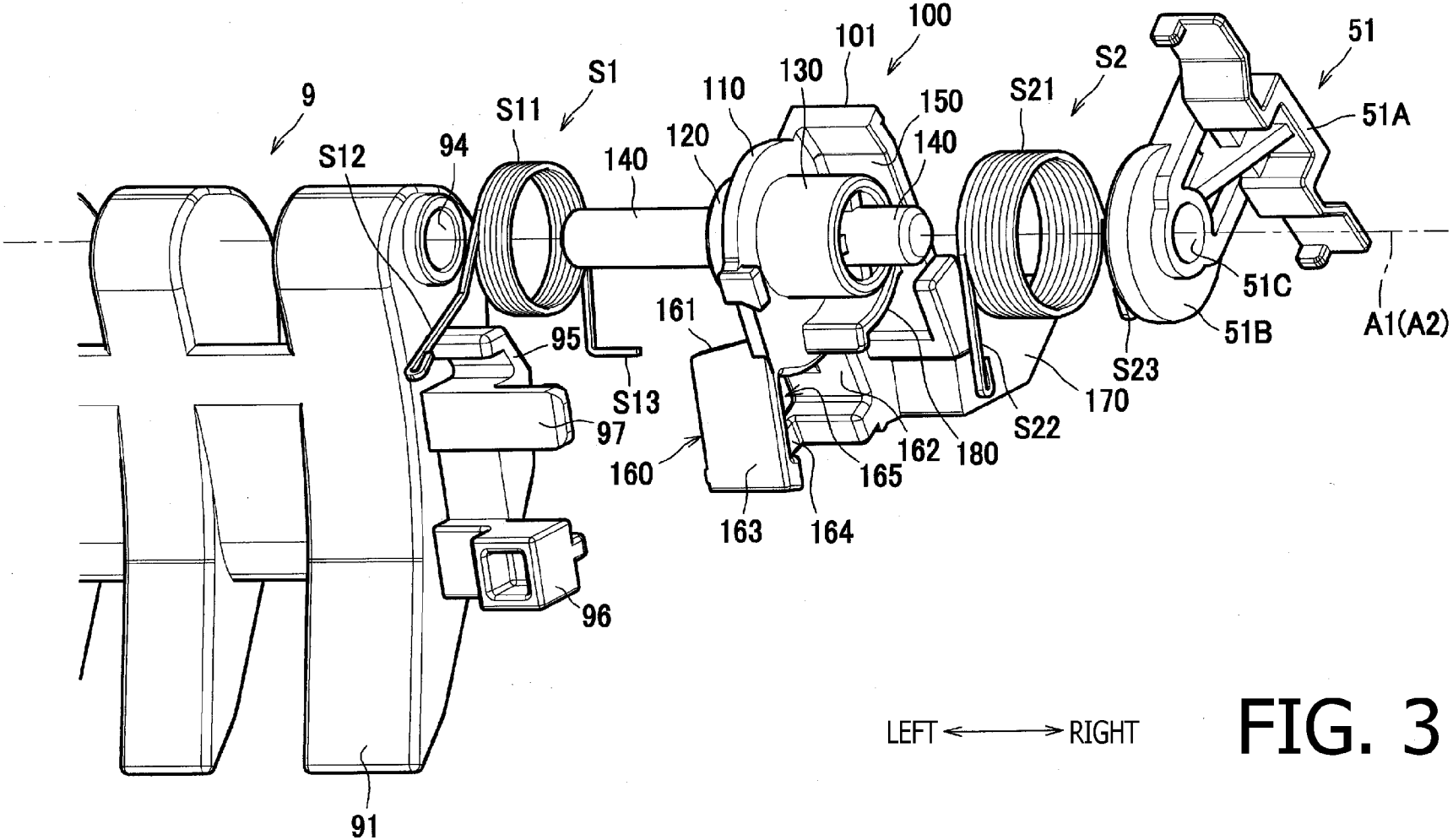
FIG. 3 is an exploded view of the flapper, a pressure link, a retainer, a first urging member, and a second urging member, according to the exemplary embodiment of the present disclosure.

The shaft 93 on the leftward end of the flapper 9 is supported by the housing 5. On the rightward end of the flapper 9, as shown in FIG. 3, an inward dent of the bearing 94 is engaged with a support shaft 140 of a pressure link 100, which is supported by the housing 5, so that the flapper 9 is swingably supported by the support shaft 140. Meanwhile, the flapper 9 is swingable with respect to the housing 5.

As shown in FIGS. 2A-2B, the first contacting part 95 is arranged in a position closer to the shaft 93 and the bearing 94 than tip ends of the guiding parts 91. The first contacting part 95 may be a rib protruding outward along the widthwise direction from the guiding part 91 on each widthwise end. Each first contacting part 95 being a rib may extend from an upper side of the guiding part 91 toward a side of the tip end, inclining toward a downstream side with regard to a swingable direction of the flapper 9 to swing from the second position toward the first position (see also FIG. 5B). The swingable direction of the flapper 9 to swing from the second position toward the first position may be, for example, in FIGS. 5A-5B, counterclockwise. The first contacting part 95 includes a first contacting surface 95A, which faces the downstream side with regard to the swingable direction of the flapper 9 to swing from the second position to the first position. It may be noted that illustration of the first contacting surface 95A on the leftmost one of the guiding parts 91 is omitted.

The second contacting part 96 is arranged in a position closer to the tip end of the guiding part 91 than the first contacting part 95. The second contacting part 96 is formed to protrude outward along the widthwise direction from the guiding part 91 on each widthwise end and to extend at a widthwise end thereof toward an upstream side with regard to the swingable direction of the flapper 9 to swing from the second position toward the first position. The second contacting part 96 includes a second contacting surface 96A, which faces the upstream side with regard to the swingable direction for the flapper 9 to swing from the second position toward the first position, at the widthwise end thereof.

The spring presser 97 is arranged in a position between the first contacting part 95 and the second contacting part 96 on the rightmost one of the guiding parts 91. The spring presser 97 may be a protrusion projecting rightward, toward the pressure link 100, from the guiding part 91. The spring presser 97 includes a first surface 97A, which faces the upstream side with regard to the swingable direction for the flapper 9 to swing from the second position toward the first position, and a second surface 97B, which faces the downstream side with regard to the swingable direction for the flapper 9 to swing from the second position toward the first position.

As shown in FIG. 3, the main body 2 has the pressure link 100 on the rightward side of the flapper 9. The pressure link 100 is coupled to the flapper 9 and includes a retainer 51 to retain the pressure link 100 on the flapper 9, a first urging member S1 arranged between the flapper 9 and the pressure link 100, and a second urging member S2 arranged between the pressure link and the housing 5.

The pressure link 100 is swingable with respect to the housing 5 and to the flapper 9. The pressure link 100 includes a main part 101, at which the pressure link 100 is coupled to the flapper 9, and a pressure-applicable part 170, which extends from the main part 101.

The main part 101 includes a plate 110, a first cylinder 120, a second cylinder 130, a support shaft 140, a first wall 150, a rib 180, and a projection 160. The plate 110 is arranged to face the upper end of the rightmost one of the guiding parts 91 along the widthwise direction. The first cylinder 120 protrudes sideward from the plate 110 toward the flapper 9. The second cylinder 130 protrudes sideward from the plate 110 in an opposite direction from the first cylinder 120. The support shaft 140 longitudinally extends along the widthwise direction through inner circumferences of the first and second cylinders 120, 130. The first wall 150 and the rib 180 protrude sideward from the plate 110 in the opposite direction from the flapper 9. The projection 160 is arranged on a side of the guiding part 91 closer to the tip end than the plate 110 and protrudes sideward to be closer to the flapper 9 than the plate 110.

The support shaft 140 is arranged integrally with the first cylinder 120 and the second cylinder 130. Therefore, the entire main part 101 may rotate integrally with the support shaft 140. The support shaft 140 protrudes sideward with respect to the first cylinder 120 toward the flapper 9 and sideward with respect to the second cylinder 130 in the opposite direction from the flapper 9. A leftward end of the support shaft 140 is engaged with the bearing 94 in the flapper 9.

The first wall 150 is arranged on the downstream side of the second cylinder 130 with regard to the swingable direction of the flapper 9 to swing from the second position toward the first position. The first wall 150 extends from an upper end of the plate 110 to a position closer to the pressure-applicable part 170 than the second cylinder 130.

Figure 4A:
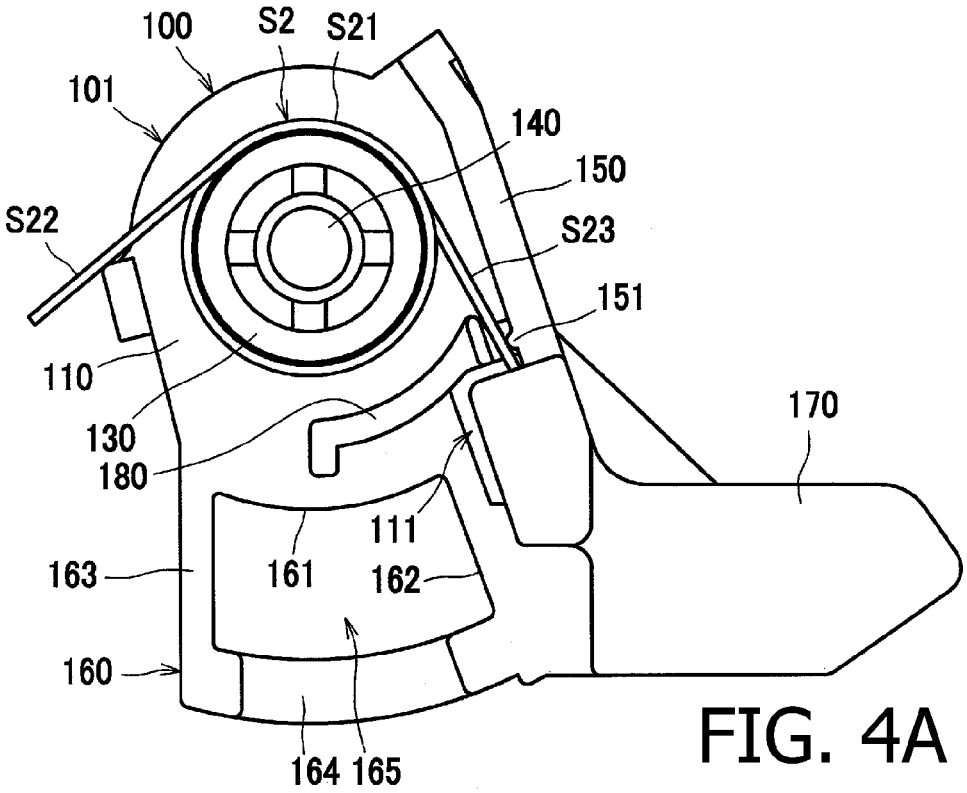
FIGS. 4A and 4B illustrate a rightward view and a leftward view of the flapper respectively according to the exemplary embodiment of the present disclosure.

As shown in FIG. 4A, the rib 180 is formed to extend from a position between the second cylinder 130 and the projection 160 along a circumference of the second cylinder 130 toward the first wall 150. An end of the rib 180 closer to the first wall 150 is separated from the first wall 150. Meanwhile, the first wall 150 has a projection 151 projecting toward the rib 180 at a position facing with the end of the rib 180.

The plate 110 is formed to have a first opening 111 formed through the widthwise direction in a position closer to the pressure-applicable part 170 than the rib 180. A part of the first wall 150 forms a downstream end of the first opening 111 with regard to the swingable direction of the flapper 9 to swing from the second position to the first position.

Figure 4B:
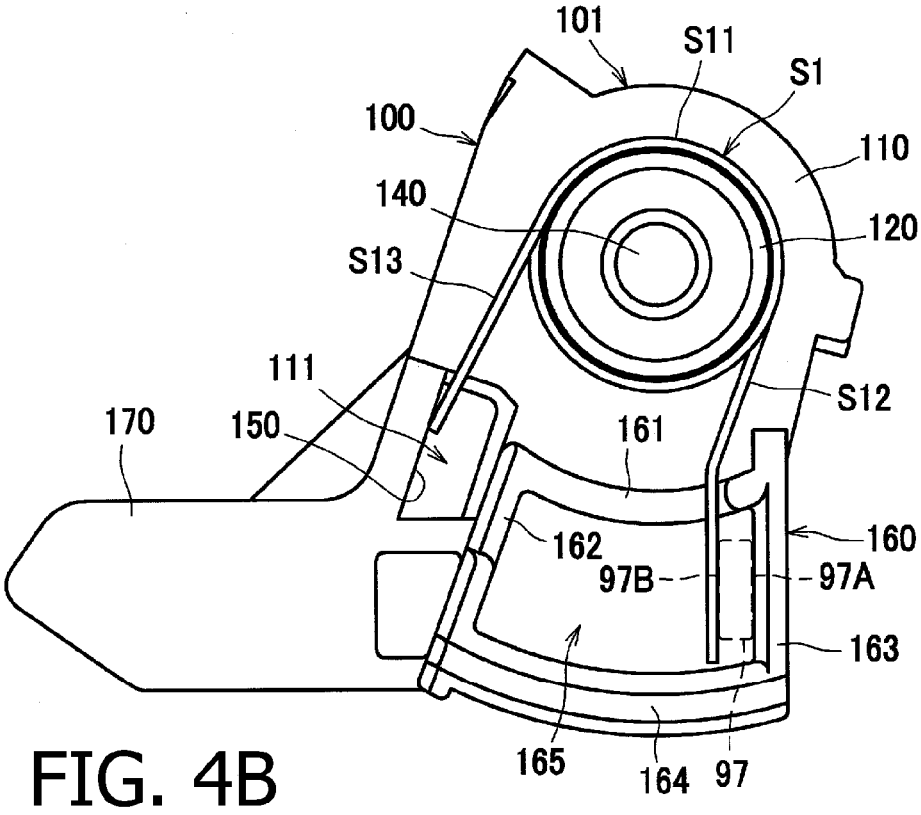

As shown in FIGS. 3 and 4B, the projection 160 includes a second wall 161, a third wall 162, a fourth wall 163, and a connecting part 164, which enclose rims of a second opening 165 formed through the main part 101. The second wall 161 protrudes from the plate 110 toward the flapper 9. The third wall 162 extends from a downstream end of the second wall 161 with regard to the swingable direction of the flapper 9 to swing from the second position to the first position in a direction opposite from the support shaft 140. The fourth wall 163 extends from an upstream end of the second wall 161 with regard to the swingable direction of the flapper 9 to swing from the second position toward the first position in the direction opposite from the support shaft 140.

The connecting part 164 connects ends of the third wall 162 and the fourth wall 163 on a side opposite from the second wall 161. Thus, the second opening 165 formed through the main part 101 is enclosed by the second wall 161, the third wall 162, the fourth wall 163, and the connecting part 164.

The second opening 165 is formed in a shape of an arc, or a sector, which spreads about a swing axis A2 of the pressure link 100. The spring presser 97 of the flapper 9 is inserted through the second opening 165 to be movable in an arc in the second opening 165. The second opening 165 is formed in the sectorial shape spreading along an urging direction of the first urging member S1 to urge a first arm S12, which will be described later in detail.

The pressure-applicable part 170 extends from a part of the main part 101 at a position closer to the tip end of the guiding part 91 than the support shaft 140 toward a downstream side with regard to the swingable direction of the flapper 9 to swing from the second position toward the first position.

The retainer 51 forms a part of the housing 5 and is arranged on one side, e.g., a right-hand side, of the pressure link 100. The retainer 51 includes a fixing part 51A and a retaining part 51B. The retaining part 51B extends from the fixing part 51A and is arranged on a right-hand side of the second cylinder 130 of the pressure link 100. The retainer part 51B includes a bearing hole 51C, in which the support shaft 140 may be inserted. With the support shaft 140 of the pressure link 100 inserted in the bearing hole 51C, the retainer 51 may support the pressure link 100 thereon.

The fixing part 51A is fixed to a part of a ceiling 52 (see FIG. 5A) of the housing 5; thereby, the pressure link 100 supported by the retainer 51 being fixed to the housing 5 is swingable with respect to the housing 5. The pressure link 100 may move between an initial position (see FIG. 5A), in which a tip end of the pressure-applicable part 170 is in an uppermost position, and a swing-down position (FIG. 6A), in which the pressure link 100 is moved to swing downward from the initial position with the pressure-applicable part 170 aligning substantially with a horizontal direction. In this regard, the swing axis A1 of the flapper 9 and the swing axis A2 of the pressure link 100 coincides with each other on a same line.

The main body 2 of the image forming apparatus 1 includes a flapper switcher 69 to move the flapper 9. The flapper switcher 69 includes a pressure-applier 69A, which may be a rod elongated in the vertical direction. With the pressure-applier 69A being moved vertically in a known method, the flapper switcher 69 is movable between a pressing position (see FIG. 6A), in which the pressure-applier 69A presses the pressure-applicable part 170 of the pressure link 100 downward to move the pressure link 100 to the swing-down position, and a separated position (see FIG. 5A), in which the pressure-applier 69A moves upward to be substantially separated from the pressure-applicable part 170. When the pressure link 100 is in the swing-down position, the pressure-applicable part 170 is in the posture to align with the horizontal direction. Meanwhile, the flapper switcher 69 may move the pressure-applier 69A to the pressing position in order to move the flapper 9 to the second position and move the pressure-applier 69A to the separated position in order to move the flapper 9 to the first position.

As shown in FIG. 3, the first urging member S1 may be a torsion coil spring including a coil S11, a first arm S12 and a second arm S13, which are extended continuously from the coil S11.

The coil S11 is arranged around the first cylinder 120 in the pressure link 100 to be supported by the first cylinder 120. As shown in FIG. 4B, the first arm S12 is arranged on the second surface 97B to be meshed with the spring presser 97 of the flapper 9. Meanwhile, the second arm S13 is arranged through the first opening 111 of the pressure link 100 to be meshed with the first wall 150. In this arrangement, the first urging member S1 urges the flapper 9 and the pressure link 100 in a direction to separate the tip ends of the guiding parts 91 in the flapper 9 apart from the tip end of the pressure-applicable part 170 of the pressure link 100 In other words, the first urging member S1 urges the spring presser 97 toward the fourth wall 163 and urges the flapper 9 in a direction from the first position toward the second position, or toward a first contact surface 54A in the housing 5, which will be described later.

When no external force is applied to the pressure link 100 or the flapper 9, the spring presser 97 is urged against the fourth wall 163 by the first urging member S1; therefore, the spring presser 97 is restricted from moving in the urging direction further beyond the fourth wall 163. On the other hand, while the flapper 9 contacts the first contact surface 54A, the pressure link 100 is swingable with respect to the flapper 9 against the urging force from the first urging member S1. In other words, the flapper 9 may swingable relatively to the pressure link 100 against the urging force from the first urging member S1 while the flapper 9 contacts the first contact surface 54A.

As shown in FIG. 3, the second urging member S2 may be a torsion coil spring including a coil S21, a first arm S21 and a second arm S22, which are extended continuously from the coil S21.

Figure 5A:
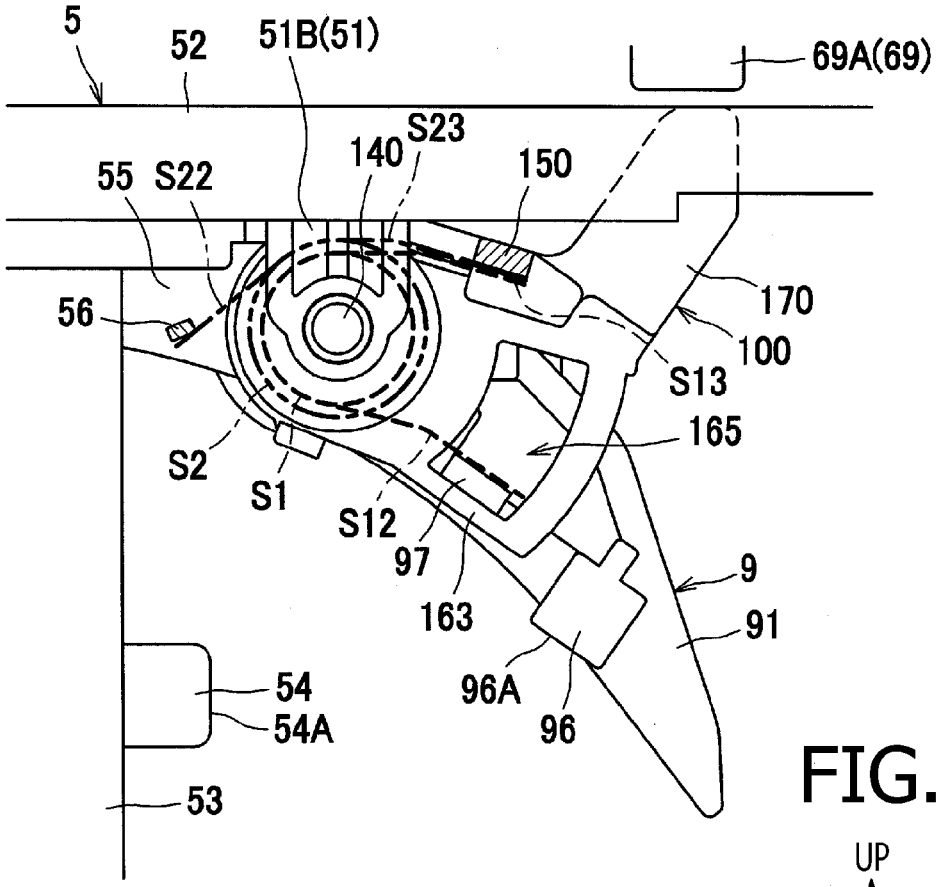
FIG. 5A illustrates the flapper and the pressure link in a first position in the laser printer according to the exemplary embodiment of the present disclosure.

The coil S21 is arranged around the second cylinder 130 in the pressure link 100 to be supported by the second cylinder 130. As shown in FIGS. 4A and 5A, the first arm S22 is arranged on a lower side of an engageable projection 56 in the housing 5, which is formed to project from an engageable wall 55 arranged frontward from the pressure link 100.

The second arm S23 is arranged in a position between the projection 151 in the first wall 150 and the rib 180 (see FIG. 4), which are not shown in FIGS. 5A-6B, to be meshed with the first wall 150 from the side of the second cylinder 130. In this arrangement, the second urging member S2 urges the pressure link 100 toward the downstream side with regard to the swingable direction of the flapper 9 to swing from the second position toward the first position. In other words, the second urging member S2 urges the pressure link 100 to act on the flapper 9 to tend toward staying in the first position.

According to the present embodiment, torque generated by the first urging member S1 is, when the pressure-applier 69A of the flapper switcher 69 is in the separated position, smaller than torque generated by the second urging member S2.

Figure 5B:
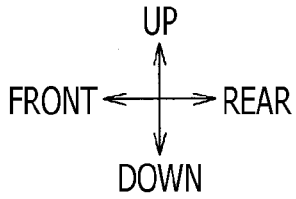
FIG. 5B illustrates the flapper and a housing in the first position in the laser printer according to the exemplary embodiment of the present disclosure.
Figure 5B:
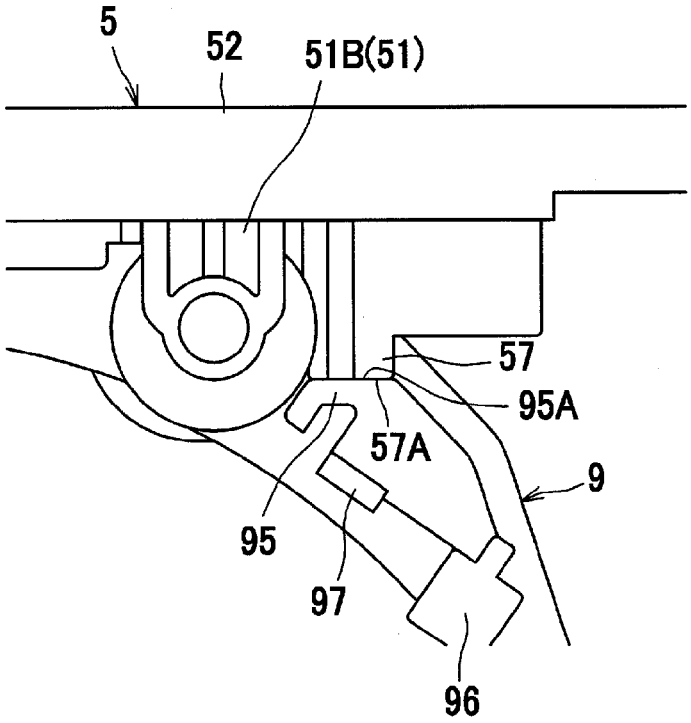

Next, a detailed configuration of the housing 5 will be described below. The housing 5 includes, as shown in FIGS. 5A-5B, the aforementioned engageable wall 55, a front wall 53, and a downward wall 57. The front wall 53 is arranged in a frontward position with respect to the flapper 9 and on each widthwise side of the flapper 9. The downward wall 57 extends downward from the ceiling 52.

The front wall 53 has a contacting projection 54, which is formed to project rearward, at a frontward position with respect to the second contacting part 96 of the flapper 9, when the flapper 9 is in the second position. The contacting projection 54 has a rearward surface, which includes the first contact surface 54A. The contacting projection 54 may, with the first contact surface 54A being collided with by the second contacting surface 96A of the flapper 9, restrict the flapper 9 from being moved further frontward beyond the second position.

As shown in FIG. 5B, the downward wall 57 is arranged in a position, in which the first contacting surface 95A of the first contacting part 95 in the flapper 9 being in the first position may contact. The downward wall 57 includes a second contacting surface 57A, which faces downward. The downward wall 57 may, with the second contacting surface 57A being collided with by the first contacting part 95 of the flapper 9, restrict the flapper 9 from moving further beyond the first position.

According to the laser printer 1 configured as above, when the sheet S being ejected is conveyed to the first outlet tray 16, as shown in FIG. 5A, the flapper switcher 69 places the pressure-applier 69A in the separated position; thereby, the pressure link 100 is placed in the initial position by the urging force from the second urging member S2. Further, the fourth wall 163 of the pressure link 100 presses the spring presser 97 in the flapper 9; thereby, the flapper 9 is placed in the first position. In this condition, as shown in FIG. 1, the first outlet path 82 is opened, and the second outlet path 83 is closed by the flapper 9. Accordingly, the sheet S conveyed through the image forming unit 7 may be ejected through the first outlet path 82 and conveyed to the first outlet tray 16.

Figure 6A:
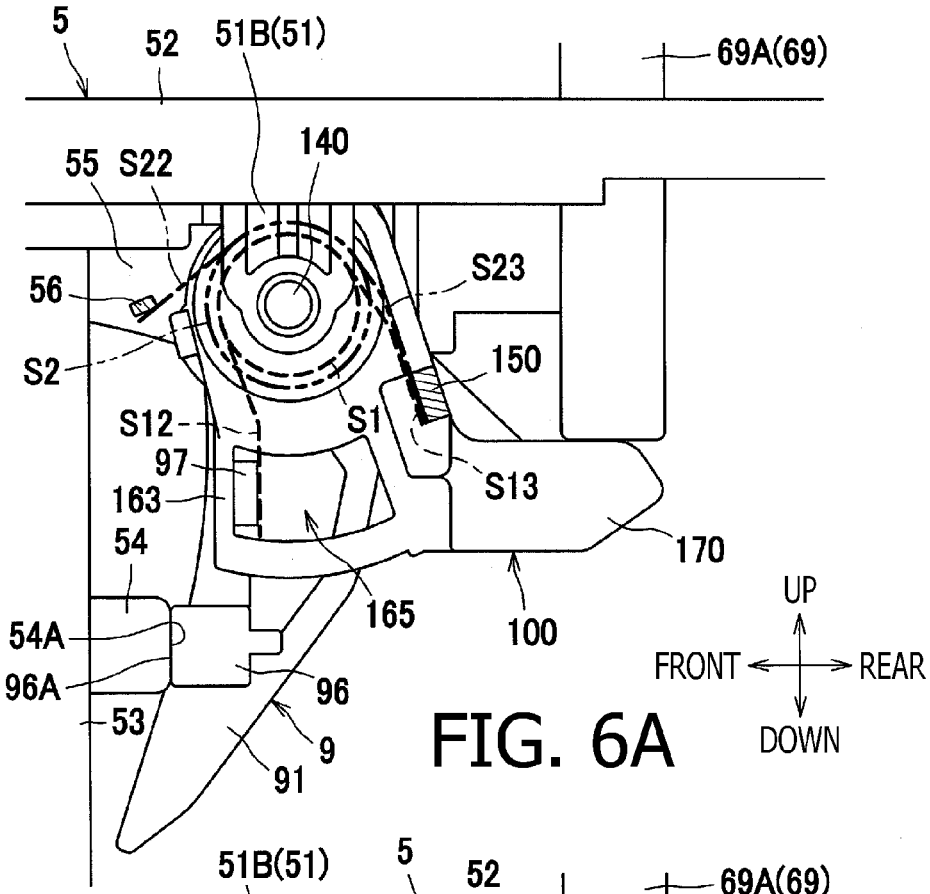
FIG. 6A illustrates the flapper and the pressure link in a second position in the laser printer according to the exemplary embodiment of the present disclosure.

When the sheet S is to be conveyed to one of the second outlet trays 61, as shown in FIG. 6A, the flapper switcher 69 moves the pressure-applier 69A downward so that the pressure-applicable part 170 in the pressure link 100 is pressed downward against the urging force from the second urging member S2. Thereby, the pressure link 100 may swing relatively to the housing 5 from the initial position in a clockwise direction in FIGS. 6A-6B.

Meanwhile, the fourth wall 163 in the pressure link 100 may tend to move away from the spring presser 97 of the flapper 9. However, while the spring presser 97 is urged against the fourth wall 163 by the urging force from the first urging member S1, the spring presser 97 maintains the contact with the fourth wall 163 and moves along with the fourth wall 163. When the second contacting surface 96A of the contacting part 96 collides with the first contact surface 54A, the flapper 9 stops at the second position.

Meanwhile, the pressure link 100 is stopped at the swing-down position, and the pressure-applier 69A in the flapper switcher 69 maintains the pressure on the pressure-applicable part 170 from above. In this condition, the pressure-applicable part 170 is in the horizontal posture; therefore, the pressure is applied by the pressure-applier 69A to the pressure-applicable part 170 in the vertical direction. Accordingly, intensity of the force required to press the pressure-applicable part 170 in the flapper switcher 69 may be reduced. In other words, the pressure-applicable part 170 may be pressed in a smaller amount of force from the flapper switcher 69.

When the flapper 9 is in the second position, as shown in FIG. 1, the first outlet path 82 is closed by the flapper 9, and the second outlet path 83 is opened. Therefore, the sheet S conveyed through the image forming unit 7 may be conveyed through the second outlet path 83 to the sheet-exit unit 3 to reach the second outlet tray 64.

Figure 6B:
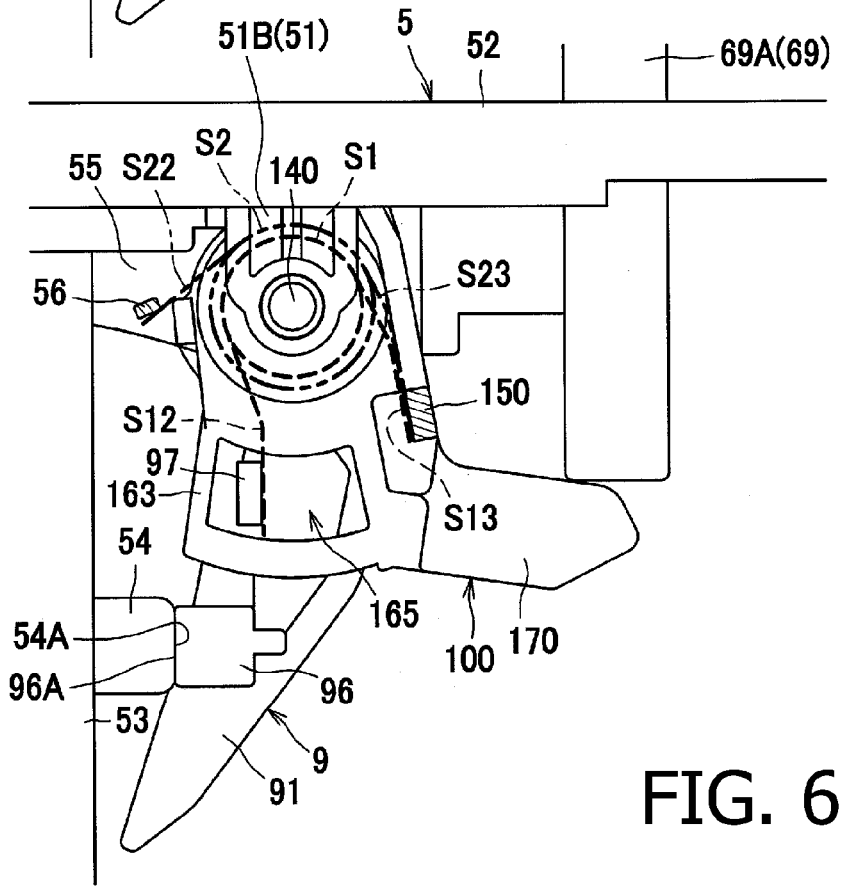
FIG. 6B illustrates the flapper and pressure link pressed further by a pressure applier beyond the second position in the laser printer according to the exemplary embodiment of the present disclosure.

When the flapper 9 is in the condition that the second contacting part 96 contacts the first contact surface 54A, as shown in FIG. 6B, the pressure-applier 69A of the flapper switcher 69 may tend to move the pressure-applicable part 170 of the pressure link 100 further beyond the swing-down position due to mechanical tolerances caused in the housing 5, the flapper 9, the pressure link 100, and/or the flapper switcher 69. According to the present embodiment, the pressure link 100 is swingable with respect to the flapper 9; therefore, even after the second contacting part 96 colliding with the first contact surface 54A, the pressure link 100 alone may swing further against the urging force from the first urging member S1. In other words, when the pressure-applier 69A presses the pressure link 100, and after the flapper 9 collides with the first contact surface 54A, the flapper 9 may swing relatively to the pressure link 100 against the urging force from the first urging member S1. Therefore, the flapper 9 and the pressure link 100 may be restrained from being damaged. Further, even if the flapper 9 collides with the first contact surface 54A with an impact with a greater intensity than a predetermined intensity, the first urging member S1 may deform to absorb the impact. Therefore, an impact noise, which may be caused by the collision between the flapper 9 and the first contact surface 54A, may be reduced.

Meanwhile, the torque from the first urging member S1 is smaller than the torque from the second urging member S2; therefore, the second contacting part 96 in the flapper 9 may be prevented from being urged forcibly against the first contact surface 54A by the first urging member S1, of which torque is smaller.

While the flapper switcher 69 is arranged in the sheet-exit unit 3 separately from the main body 2, as it is in the present embodiment, the pressure-applier 69A in the flapper switcher 69 may be displaced relatively from the pressure link 100 easily. However, with the pressure link 100 which is swingable relatively to the flapper 9, the displacement may be absorbed.

When, for example, the sheet S is conveyed to the second outlet tray 61, and another sheet S is to be conveyed to the first outlet tray 16, as shown in FIG. 5A, the pressure-applier 69A in the flapper switcher 69 may move to the separated position. Accordingly, the pressure link 100 may be moved to swing counterclockwise in FIGS. 5A-5B by the urging force from the second urging member S2. In this regard, with the spring presser 97 being urged against the fourth wall 163 in the pressure link 100, the flapper 9 may move to swing from the second position toward the first position along with the pressure link 100. When the first contacting part 95 in the flapper 9 collides with the second contacting surface 57A in the housing 5, the flapper 9 may stop at the first position. Meanwhile, the pressure link 100 may also stop swinging. Thus, with the flapper 9 being placed to contact the second contacting surface 57A in the housing 5, the flapper 9 may be maintained in the first position. Accordingly, the positional accuracy of the flapper 9 with respect to the housing 5, when the flapper 9 is in the first position, may be improved.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the flapper switcher 69 may not necessarily be arranged in the sheet-exit unit 3 but may be arranged in the main body 2.

For another example, the flapper 9 and the pressure link 100 may not necessarily be arranged in the main body 100 to switch the conveying directions to convey the sheets S in the main body 2 but may be arranged in the sheet-exit unit 3.

For another example, the swing axis A1 of the flapper 9 and the swing axis A2 of the pressure link 100 may not necessarily coincide with each other on the same line. The swing axis A1 of the flapper 9 may be displaced from the swing axis A2 of the pressure link 100 and align with a direction orthogonal to the swing axis of the pressure link 100.

For another example, the present disclosure may not necessarily be applied to a laser printer, in which the sheet-exit unit 3 is attachable on top of the main body 2, but may be applied to an image forming apparatus having no sheet-exit unit. For another example, the present disclosure may not necessarily be applied to a monochrome laser printer 1 but may be applied to a multicolor printer.

What is claimed is:

1. An image forming apparatus, comprising:

a housing;

a flapper configured to be swingable with respect to the housing on a swing track and movable between a first position and a second position on the swing track;

a pressure link configured to be swingable with respect to the housing and the flapper, the pressure link being coupled to the flapper;

a first contact surface arranged on the housing, the first contact surface being configured to contact the flapper and restrict the flapper from moving beyond the second position;

a first urging member arranged between the pressure link and the flapper, the first urging member being configured to urge the flapper to swing with respect to the pressure link toward the first contact surface;

a second urging member arranged between the housing and the pressure link, the second urging member being configured to urge the pressure link to act on the flapper to tend toward staying in the first position; and a flapper switcher comprising a pressure applier, the pressure applier being configured to move between a pressing position, in which the pressure applier presses the pressure link, and a separated position, in which the pressure applier is separated from the pressure link, wherein the flapper is swingable with respect to the pressure link against an urging force from the first urging member, after the pressure applier presses the pressure link to move the flapper from the first position to the second position against an urging force from the second urging member and when the flapper being moved contacts the first contact surface.

2. The image forming apparatus according to claim 1, wherein the flapper comprises a projection, the projection projecting toward the pressure link;

wherein the pressure link is formed to have an opening, through which the projection is inserted, the opening being in a shape spreading along an urging direction of the urging force from the first urging member; and wherein the pressure link comprises a wall part, the wall part being configured to contact the projection and restrict the flapper from moving with respect to the pressure link in the urging direction of the urging force from the first urging member by contacting the projection.

3. The image forming apparatus according to claim 2, wherein the projection is urged by the first urging member toward the wall part.

4. The image forming apparatus according to claim 2, wherein the projection is formed to project in a direction of a swing axis of the flapper.

5. The image forming apparatus according to claim 1, wherein a swing axis of the flapper and a swing axis of the pressure link coincide with each other on a same line.

6. The image forming apparatus according to claim 1, wherein the pressure link comprises a support shaft; and wherein the flapper is swingably supported by the support shaft of the pressure link.

7. The image forming apparatus according to claim 1, further comprising:

a second contact surface arranged in the housing, the second contact surface being configured to contact the flapper to restrict the flapper from moving beyond the first position in an urging direction of the urging force from the second urging member.

8. The image forming apparatus according to claim 1, wherein each of the first urging member and the second urging member is a torsion coil spring; and wherein the pressure link comprises a first supporting part configured to support a coil in the first urging member and a second supporting part configured to support a coil in the second urging member.

9. The image forming apparatus according to claim 1, wherein, when the flapper switcher is in the separated position, an intensity of torque generated by the first urging member is smaller than an intensity of torque generated by the second urging member.

10. The image forming apparatus according to claim 1, further comprising:

a main body and a sheet-exit unit attachable to the main body, the main body comprising a first outlet tray and the housing, the sheet-exit unit comprising a second outlet tray;

wherein the flapper switcher is arranged in the sheet-exit unit; and wherein the flapper and the pressure link are arranged in the main body.

* * * * *